United States Patent [19]

Iwane

[11] 4,420,267

[45] Dec. 13, 1983

[54] SERIAL PRINTER

[75] Inventor: Yasuhiko Iwane, Tamayama, Japan

[73] Assignee: Alps Electric Co., Ltd., Tokyo, Japan

[21] Appl. No.: 333,770

[22] Filed: Dec. 23, 1981

[30] Foreign Application Priority Data

Dec. 25, 1980 [JP] Japan ..... 55-184676

[51] Int. Cl.[3] ..... B41J 1/50; B41J 7/34

[52] U.S. Cl. ..... 400/149; 400/332.6; 400/328; 101/93.11; 101/93.17

[58] Field of Search ..... 101/93.15–93.17, 101/93.11; 400/328, 328.1, 82, 332, 323, 149

[56] References Cited

U.S. PATENT DOCUMENTS

| | | | |
|---|---|---|---|
| 3,608,692 | 9/1971 | Henry | 400/328 |
| 3,651,914 | 3/1972 | Locke | 400/328 |
| 3,710,912 | 1/1973 | Bretti et al. | 101/93.16 |
| 3,739,899 | 6/1973 | Brumbaugh et al. | 400/332.6 |
| 3,867,676 | 2/1975 | Chai et al. | 318/135 |
| 4,051,942 | 10/1977 | Suzuki et al. | 101/93.16 |
| 4,167,345 | 9/1979 | Englund et al. | 400/328 |
| 4,198,170 | 4/1980 | Decker | 400/323 |
| 4,244,291 | 1/1981 | Kodaira et al. | 101/93.17 |
| 4,352,576 | 10/1982 | Hori et al. | 101/93.17 |

FOREIGN PATENT DOCUMENTS

| | | | |
|---|---|---|---|
| 2056918 | 3/1981 | United Kingdom | 101/93.17 |

OTHER PUBLICATIONS

Pawletko et al., "High Speed Printer" IBM Technical Disclosure Bulletin, vol. 19, No. 9, pp. 3355–3356, 2/77.

*Primary Examiner*—William Pieprz
*Attorney, Agent, or Firm*—Guy W. Shoup; Gerard F. Dunne

[57] ABSTRACT

A serial printer of the type in which a column shift of a carriage carrying a type wheel is effected through a mutual engagement between the rack and the screw member. A first and a second screw members are splined to a common shaft adapted to be driven by a suitable power source. The first and second screw members are rotatably carried by a first and a second carriages having reset positions defined at opposite ends of the printer. The first and the second screw members have screw threads inclined in opposite directions and adapted to mesh with the teeth of a common rack which is slidable over a predetermined stroke in the column-shift direction and adapted to be driven by a suitable driving member. By making the type wheels rotate by a number greater than that required for ordinary type selecting operation, the rack is slided by the driving member to selectively engage one of the first and second screw members thereby to shift the selected one of carriages.

13 Claims, 14 Drawing Figures

SERIAL PRINTER

BACKGROUND OF THE INVENTION

The present invention relates to an impact serial printer of small size and having a relatively large number of type elements.

Recently, there has been remarkable progress in the development of personal type printers and printers suitable for use in hand held devices, particularly in the use of small-sized and light-weight printers in desk-top calculators and the like. As the printer incorporated in such calculators, so-called impact type serial printer are most welcomed partly because it can provide a clean printing of data and partly because it is suitable for a printing on ordinary paper.

This type of printer, although the size is small and the construction is advantageously simple, is inferior to the conventional large-sized printer in that the number of type elements mounted on a type wheel is limited and this undesirably restricts the variety of characters that can be printed.

To overcome this problem, the present applicant has proposed in Japanese Patent Publication No. 9298/1980 corresponding to U.S. Pat. No. 4,051,942, a small-sized serial printer having two type wheels one of which being shiftable in the direction of the line to be printed while the other being held at the initial column position. In operation, the type elements of these type wheels are selectively struck to effect the printing. This serial printer can have a small size and be comparatively compact because only one type wheel is shiftable. However, if the overall size of the printer has to be maintained small, it becomes impossible to have a large diameter for the type wheel, so that the number of the type elements is naturally limited. In addition, it is difficult to make two-color printing.

SUMMARY OF THE INVENTION

Accordingly, an object of the invention is to provide a serial printer capable of overcoming the above-described problems of the prior art.

To this end, according to the invention, there is provided a serial printer having two shiftable type wheels adapted to be carried and struck selectively to permit an increase in the number of type elements and to enable two-color printing thereby to diversify the content of the printing data.

The above and other objects, as well as advantageous features of the invention will become clear from the following description of the preferred embodiment taken in conjunction with the accompanying drawings.

DESCRIPTION OF THE PREFERRED EMBODIMENTS

Figure 1:
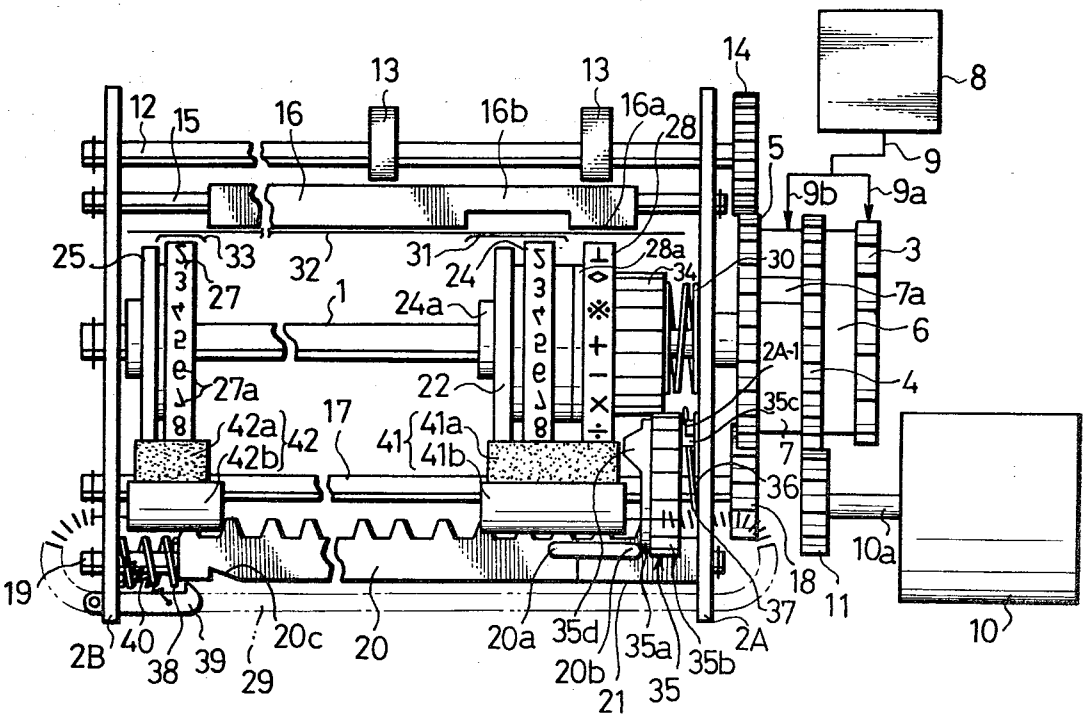
FIG. 1 is a partly simplified plan view of a serial printer in accordance with an embodiment of the invention.
Figure 2:
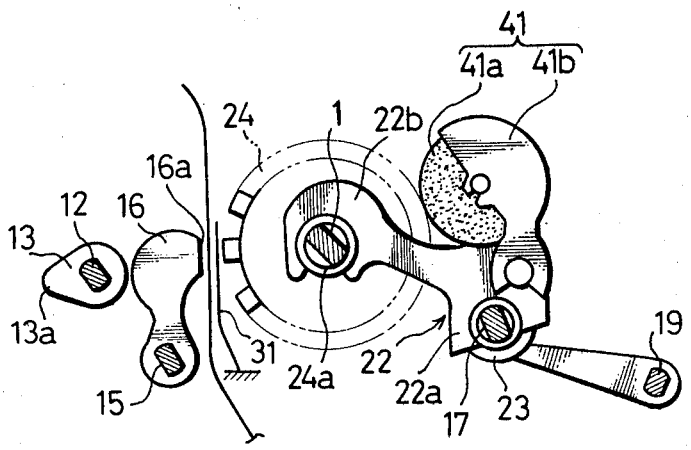
FIG. 2 is a sectional view of essential part of the serial printer shown in FIG. 1.
Figure 3:
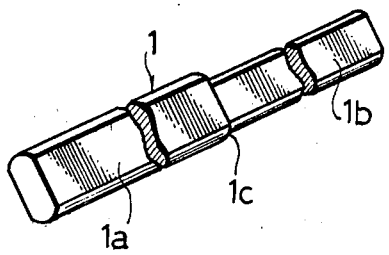
FIG. 3 is a perspective view of a type wheel shaft.

Referring to FIGS. 1 to 12 showing a first embodiment of the invention, a serial printer has two frame members 2A,2B rotatably carrying a type wheel shaft 1 having substantially oval cross-section. As shown in FIG. 3, the type wheel shaft 1 has a large-diameter portion 1*a*, small-diameter portion 1*b* and a step portion 1*c* separating the two.

The small-diameter portion 1*b* of the type wheel shaft 1 projects rightwardly from the frame member 2A by a predetermined projection amount. A ratchet 3 is fixed to the projected part of the small-diameter portion 1*b*. The projected part also carries gears 4,5 rotatably relative to the type wheel shaft 1. A reference numeral 6 designates a first clutch means connected between the gear 4 and the rachet 3 and held to the type wheel shaft 1, so as to control the power transmission between the gear 4 and the shaft 1. A second clutch means 7 provided with an outer peripheral cam groove 7*a* is connected between the gears 4 and 5 to control the power transmission therebetween.

The clutch means 6,7 are adapted to be controlled by an actuator lever 9 which in turn is driven by a solenoid 8. The actuator lever 9 has one end 9*a* engageable with the ratchet 3 and the other end engageable with the cam groove 7*a*. The arrangement is such that, while the one end 9*a* of the actuator lever 9 is in engagement with the ratchet 3, the other end 9*b* is out of engagement with the cam groove 7*a*. To the contrary, while the other end 9*b* is in engagement with the cam groove 7*a*, the one end 9*a* is out of engagement with the ratchet 3. Thus, these members in combination function as a so called mechanical flip-flop. The gear 4 and the type wheel shaft 1, i.e. the ratchet 3, rotate as a unit when the lever 9 is in engagement with the cam groove 7*a*, so that no torque is transmitted between the gears 4 and 5. To the contrary, when the lever 9 is in engagement with the ratchet 3, the gears 4 and 5 are rotatable as a unit and the gear 4 is disconnected from the type sheel shaft 1.

A D.C. motor 10 has an output shaft 10*a* to which is attached a gear 11 meshing with the gear 4. Thus, the torque of the motor 10 is selectively transmitted to the type wheel shaft 1 and the gear 5 through the gear 4.

A reference numeral 12 designates a hammer drive shaft supported between the frame members 2A,2B and carrying a hammer driving cam 13. A gear 14 on the hammer driving shaft 12 meshes with the gear 5. A hammer member 16 having a striking surface 16*a* of a length corresponding to one line of printing is secured to a hammer shaft 15 supported between the frame members 2A and 2B. A reference numeral 17 designates a rotatable guide shaft supported between the frame members 2A and 2B and adapted to shift a carriage which will be mentioned later and having a non-circular cross-section. A gear 18 attached to one end of this shaft engages the aforementioned gear 5.

A rack shaft 19 having a non-circular cross-section is mounted between the frame members 2A and 2B for rotation over a predetermined angle. An elongated rack 20 is carried by the rack shaft 19 in such a manner so as to be able to slide over a predetermined length along the shaft 19 but not rotatable relatively to the same, i.e. by a spline connection. A short rack 21 is press-fitted and fixed to the end of the shaft 19 adjacent to the frame member 2A.

A reference numeral 22 designates a first carriage with a base 22*a* (see FIG. 2) having a circular bore receiving the aformentioned guide shaft 17 so as to slide along the latter. A reference numeral 23 designates a first screw member carried by the lower part of the base 22*a* rotatably. This first screw member 23 is splined to the guide shaft 17 so as to be able to slide along the latter but is not rotatable relative the same. The aforementioned racks 20,21 engage a tooth of the first screw member 23 which is exposed from the lower side of the base 22*a*. Although not shown, the tooth of the screw member 23 extends in the circumferential direction over approximately half the circumference of the screw member and spirals over approximately the remainder half circumference. The arrangement is such that the rack 20 or the rack 21 engages the sprial portion of the tooth of the screw member 23 in the later half portion of rotation of the guide shaft 17, thereby to shift the first screw member 23 and, hence, the first carriage 23 to the left as viewed in the drawing by a distance corresponding to the pitch of the columns to be printed.

A reference numeral 24 designates a first type wheel carrying numeral type elements and is provided at its center with a substantially oval bore (not shown) conforming to the cross-section of the large-diameter portion 1*a* of the type wheel shaft 1 so as to receive the latter and rotate as a unit therewith. The type wheel 24 is slidable over the large-diameter portion 1*a* and small-diameter portion 1*b* of the type wheel shaft. As will be seen from FIG. 2, an annular groove is formed in a hub 24*a* projected from one side of the type wheel 24 and is engaged by an arm 22*b* of the carriage 22, so that the first type wheel 24 is moved together with the carriage 22 while being rotatably held by the latter.

A second carrage 25 has a construction substantially identical to that of the fist carriage and is provided with a base 25*a* (See FIG. 7) having a bore slidably receiving the guide shaft 17. The base 25*a* carries a second screw member 25*a* splined to the guide shaft 17. As will be seen from FIG. 7, the second screw member 26 has a shape similar to that of the first screw member 23, i.e. with a tooth extending circumferentially over approximately a half circumference and spiralling over approximately the remainder half circumference. The spiral portion of the tooth of this second screw member 25, however, has an inclination to the axis in the opposite direction to the spiral portion of the tooth of the first screw member. As in the case of the first screw member, the spiral tooth portion engages with the rack 20 in the later half part of the rotation of guide shaft 17 so as to be rotated by the latter thereby to shift the second carriage 25 in the direction opposite to the direction of shift of the first carriage, i.e. to the right as viewed in FIG. 1 by a distance corresponding to one pitch of the columns.

A reference numeral 27 designates a second type wheel for numeral type elements splined to the type wheel shaft 1 as in the case of the first type wheel 24 for numeral type elements. The second type wheel 27 is adapted to be shifted as a unit with the second carriage 25 while being held rotatably by the latter. As in the case of the first type wheel 24, the second type wheel 27 has a hub with an annular groove engaged by an arm 25*b* of the second carriage 25.

A reference numeral 28 designates a type wheel for function characters, and is provided at its central portion with a substantially oval small hole (not shown) conforming to the cross-section of the small-diameter portion 1*b* of the type wheel shaft 1 so as to be able to receive that portion 1*b* of the type wheel shaft 1 and rotate as a unit with the latter and to slide only along the small-diameter portion 1*b* of the shaft 1.

A reference numral 29 desigates a reset spring connected at one end to the first carriage 22 and at the other end to the second carriage 25 for resetting these carriages. Namely, the spring 29 continuously urges the first carriage 22 rightwardly and the second carriage 25 leftwardly as viewed in FIG. 1, i.e. toward the home positions of the respective carriages. As an instruction is given for resetting the first carriage 22 from a control circuit of the printer, the racks 20,21 are rotated so that the rack 20 or 21 comes out of engagement with the first screw member 23 to permit the first carriage to be rapidly reset to the home position. The resetting of the second carriage 25 can be made in a similar manner. Namely, as the rack 20 is rotated, it comes out of any engagement with the second screw member 26 to permit the second carriage 25 to be quickly returned to the home position.

The type wheel 28 of function characters is always biased leftward as viewed in FIG. 1 by a spring 30 attached to the portion of the type wheel shaft 1 between the frame member 2A and the function character type wheel 28. In the state shown in FIG. 1 in which printing is to be commenced for one line, since the spring constant of the spring 29 is selected to be greater than that of the spring 30, the first type wheel 24 presses at its side surface the hub 28*a* of the type wheel 28 for function characters, so that the latter is shifted to the right as viewed in FIG. 1 to locate the type wheel 28 at a position facing the striking surface 16*a* of the hammer member 16, while locating the first type wheel 24 at a position confronting a notch 16*b* formed in the hammer member 16.

The notch 16*b* formed in the hammer member has a width substantially corresponding to two pitches for the shift of the carriage 22, and is opposed by a mask 31 made of a resilient thin metallic web material. The above-mentioned mask 31 has a width substantially equal to the width of the notch 16*b* so as to prevent printing by the portion of the printing paper between the hammer member 16 and the mask 31. However, when the hammer 16 is to be operated, the mask 31 comes into the notch 16*b* together with a part of the printing paper 32.

A second mask 33 takes a position between the printing paper 32 and the second type wheel 27 when the latter is in its home position, thereby to prevent unnecessary printing on the printing paper 32. Since this second mask 33 has a width substantially equal to the width of the second type wheel, the second type wheel 27 clears the mask 33 to directly face the printing paper 32 after the shift of the second carriage 25 by one pitch.

A gear 34 is provided at its center with a substantially oval hole conforming to the cross-section of the small-diameter portion 1*b* of the type wheel shaft 1 to receive the latter, so as to be able to rotate as a unit with the type wheel shaft 1. In addition, the gear 34 is pressed by the force of the spring 30 into contact with the function character type wheel 28 to slide on the small-diameter portion 1*b* of the type wheel shaft 1 as the type wheel 28 is shifted. A reference numeral 35 denotes a cam gear (driving member) rotatably held by a shaft 36 attached to the frame member 2A and provided with a cam portion 35*a* and a gear portion 35*b*. In the printing starting position shown in FIG. 1, i.e. when the function character type wheel 28 and the gear 24 take the rightmost position, the gear portion 35*b* formed on the right half part of the cam gear 35 meshes with the aforementioned gear 34 so that the cam gear 35 is rotated in accordance with the rotation of the type wheel shaft 1, at a speed determined by the gear ratio.

However, when the gear 34 has been moved along the type wheel shaft 1 by a distance of one or more pitches of column as a result of the leftward movement of the type wheel 28 as viewed in FIG. 1, the gear 34 is out of engagement with the cam gear 35 so that the latter is held at its initial position which will be explained later.

A reference numeral 37 designates a reset spring for resetting the cam gear 35. The spring 37 loosely fits around the shaft 36 and is connected at its one end to the frame member 2A and retained at its other end by the cam gear 35, thereby to continuously urge the latter in the direction opposite to the direction of rotation thereof caused by the gear 34.

A stopper 35*c* projecting from the gear portion 35*b* of the cam gear 35 is pressed in the initial state against a stopper projection 2A-l on the frame member 2A provided on the locus of rotation of the stopper 35*c*, by the torque generated by the reset spring 37.

The cam portion 35*a* of the cam gear 35 has a disk-like form with a protrusion 35*d* formed on one side thereof. A lever 20*a* integral with the rack 20 is biased by a spring 38 acting between the frame member 2B and the rack 20 to place its end into continuous contact with the end surface of the cam portion 35*a* of the cam gear 35, so that the track 20 can be moved by a distance corresponding to the height of the protrusion on the end surface of the cam portion 35*b* as the cam gear 35 rotates.

Figure 4:
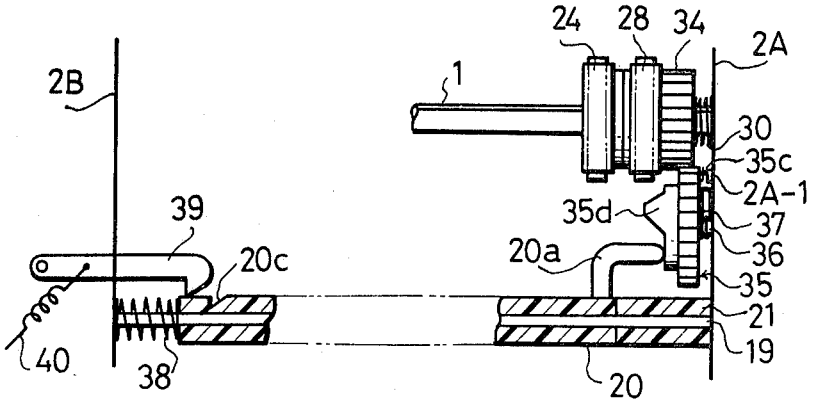
FIGS. 4 to 6 are illustrations of the operation of a cam gear and a rack.

In the state shown in FIGS. 1 and 4 preparing for the starting of the printing operation, the end of the lever 20*a* is contacting a portion of the cam gear 35 other than the protrusion 35*d*, so that the rack 20 is held at its position closest to the frame member 2A. A reference numeral 39 designates a retainer claw which is normally pressed against the rack 20 by means of the spring 40.

A reference numeral 20*c* denotes a notch formed in the rack 20 and adapted to be engaged by the retainer claw 39 when the rack 20 is moved toward the frame member 2B by the pressure contact between the end of the lever 20*a* and the protrusion 35*d* of the cam gear 35 after the rotation of the cam gear 35 by a predetermined angle from the stand-by position shown in FIG. 1.

Ink supply means 41,42 are secured to the carriages 22,25, respectively, so as to supply the type wheels 24,28 and 27 with ink. More specifically, these means 41,42 have ink rollers 41*a*,42*a* impregnated with ink, ink roller covers 41*b*,42*b* rotatably supporting respective ink rollers 41*a*,42*a* and detachably secured to the carriages 22,25, and springs (not shown) adapted to press the ink roller covers 41*b*,42*b* to resiliently press the ink rollers 41*a*,42*a* against the respective type wheels. In the illustrated embodiment, the ink roller 41*a* is impregnated with a blue ink, while the ink roller 42*a* is impregnated with a red ink so that two-color printing can be achieved.

The serial printer of the illustrated embodiment having the construction heretofore described operates in a manner explained hereinunder.

First of all, it is to be understood that there are two modes of operation of the serial printer of the invention: namely, a first mode in which the printing by the first type wheel 24 for numeral characters is made subsequent to the printing by the type wheel 28 for the function characters; and a second mode in which the printing by the second type wheel 27 for numeral characters is effected subsequent to the printing by the type wheel 28. Therefore, the following description will be made mainly on the first mode of operation, and the difference of operation between the first and second modes will be explained hereafter. FIGS. 4 to 12 illustrate the operation schematically and the retainer claw 39 and the notch 20*c* are shown in these Figures in inversed positional relation to that shown in FIG. 1 for convenience's sake.

In the state shown in FIG. 1 preparing for the starting of printing, the type wheel 28 for the function characters is positioned opposite the striking surface 16*a* of the hammer member 16 while the first and the second type wheels 24 and 27 take positions to face respective masks 31 and 33, as stated already. At the same time, the actuator rod 9 of the solenoid 8 is pressed by a spring (not shown) to engage the cam groove 7*a* of the second clutch means 7, so that the torque of the motor 10 can be transmitted to the type wheel shaft 1 and the ratchet 3 through the gear 4 and the first clutch means 6.

Then, as the motor 10 is started, the type wheel shaft 1 is rotated to rotatively drive the type wheels 24,28 and 27 and these type wheels are applied at their peripheries with ink in the first one full rotation thereof. During the next one full rotation of these type wheels, a printing instruction from a control circuit of the printer is given to operate the solenoid 8 so that the actuating lever 9 disengages the cam groove 7*a* of the second clutch means 7 and moves into engagement with the ratchet 3 to disengage the first clutch means 6 thereby to disconnect the type wheel shaft 1 from the motor 10. In consequence, the type wheel shaft 1 is stopped and the type wheel 28 for function characters is stopped with the selected type element confronting the striking surface 16*a* of the hammer member 16.

The energization of the solenid 8 for the above-described selection of a type element is made only temporarily. As the actuating lever is disengaged from the cam groove 7*a* of the second clutch means 7, the torque of the motor 10 is transmitted without delay to the second clutch means 7 and the gear 5 through the gear 4, and, as a result of the rotation of the second clutch means 7, the actuating lever 9 which is biased by the spring toward the second clutch means comes to make a resilient contact with the outer peripheral surface of the clutch means 7. Thus, the actuating lever is kept in engagement with the ratchet 3 until the next came groove 7*a* is brought to the position for receiving the actuating lever 9, thereby to keep the first clutch means 6 in an off state, i.e. in non-torque transmitting condition, while keeping the second clutch means 7 in one state, i.e. in the state capable of transmitting the torque.

Therefore, the torque of the motor 10 is transmitted to the gear 5 while the type wheel 28 for function characters is stopped at the position confronting the striking surface 16*a* of the hammer member 16, thereby to drive the gear 14 meshing with the gear 5 and also the gear 18 to rotate the hammer drive shaft 12 and the guide shaft 17 in synchronization with each other.

Before the solenoid 8 is energized, the type wheel shaft 1 is rotated to drive the gear 34 and the cam gear 35 having the gear portion 35*b* meshing with the gear 34. As stated before, the type wheel shaft 1 is stopped only after it makes less than one full rotation for positioning the desired type of the function character type wheel 28 at the position confronting the striking surface 16*a* of the hammer member, subsequent to one full rotation for applying ink to the type elements held by outer peripheries of the type wheels 24,28 and 27. Therefore, in the ordinary type selecting operation, the number of rotations of the type wheel is maintained under a predetermined number. Since there is an upper limit of the rotation number of the type wheel shaft 1, the rotation of the cam gear 35 has an upper limit for its angle of rotation which is determined by the gear ratio between the gear 34 and the gear portion 35*b* of the cam gear 35.

Figure 5:
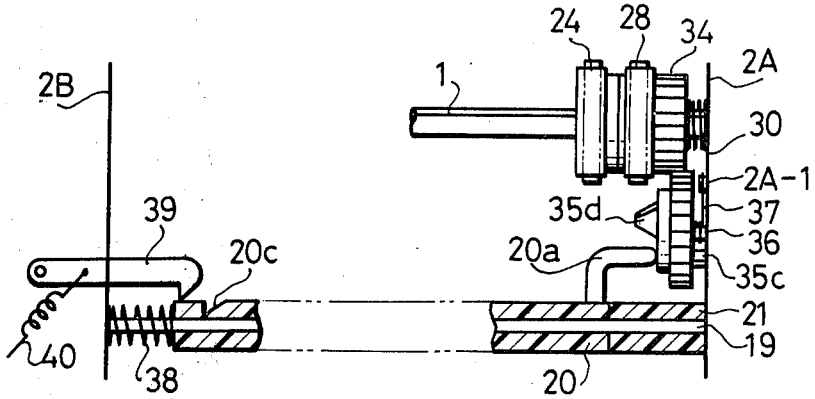

It is also to be pointed out that, as stated before, the lever 20*a* unitary with the rack 20 is held in contact with the portion of the cam gear 35 other than the protrusion 35*d* of cam portion 35*a*, in the stand-by position as shown in FIG. 1. Therefore, by selecting the rotation angle of the cam gear 35 so that the contact between the lever 20*a* and the protrusion 35*d* is not made until after the aforementioned upper limit of rotation angle has been reached, the lever 20*a* is completely kept away from the protrusion 35*d* of the cam gear 35. Therefore, the rack 20 is not moved toward the frame member 2B and the positional relationship as shown in FIG. 5 is maintained.

As a result of the switching of the clutch means explained before, the type wheel shaft 1 is stopped and the hammer drive shaft 12 starts to rotate. Then, as the hammer drive shaft 12, rotates through the first half of a full revolution the projection 13*a* (See FIG. 2) of the hammer driving cam 13 presses the back side of the hammer member 16 to rotate the latter around the axis of the hammer shaft 15. In consequence, the striking surface 16*a* is pressed against the printing paper 32 to press the latter onto the type wheel 28 for the function character wheel 28 as shown in FIG. 2, thereby to print the desired character at the lowermost place or column on the printing paper 32.

Meanwhile, the guide shaft 17 is being rotated together with the hammer drive shaft 12. However, as explained before, the spiral tooth portion of the first screw 23 does not engage the rack 21 as the guide shaft 17 rotates through the first half of a full revolution but meshes with the same only after the rotation of the hammer member 16 is completed following the first half of the rotation of the hammer drive shaft 13, i.e., in the latter half of the rotation of the guide shaft 17. Although not shown, the hammer member 16 is automatically reset to the non-printing position by the action of a spring.

Figure 8:
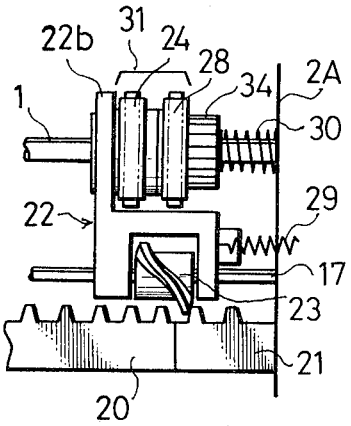

Consequently, the first carriage 22 is shifted by a distance corresponding to one pitch of the column to the position shown in FIG. 8 as the spiral portion of the tooth of the first screw member 23 engages the teeth of the rack 20. Accordingly, the type wheel 28 for function characteristics is also moved to the left as viewed in the drawings by the force exerted by the spring 30, from the position shown in FIG. 7 to the position shown in FIG. 8. The movement of the type wheel 28 for function characters is accompanied by the leftward movement of the gear 34 so that the latter disengages from the gear portion 35*b* of the cam gear 35 thereby to permit the cam gear 35 to be rotated by the force of the reset spring 37 until the stopper 35*c* of the cam gear 35 is stopped by the projection 2A-1 of the frame member 2A, i.e. back to the initial position mentioned before. Namely, the cam gear 35 is reset from the state shown in FIG. 5 to the state shown in FIG. 4.

On the other hand, the second screw member 26, which is out of engagement with the rack 20, does not cause the column shift of the second carriage 25 and the second type wheel 27 carried by the latter.

After the completion of the driving of the hammer member 16 and the column shift of the first carriage 22 by one pitch of column, i.e. after completion of one full rotation of the hammer drive shaft 12 and the guide shaft 17, the second clutch means 7 which rotate in synchronization with these shafts makes a half rotation to bring a cam groove 7*a* thereof to the position opposing the actuating lever 9 to permit the latter to be pressed into the cam groove 7*a* by the force of the spring, while the other end of the lever 9 is disengaged from the ratchet 3 to turn the first and second clutch means 6 and 7 on and off, respectively. In this state, the torque of the motor 10 is transitted only to the type wheel shaft 1 to resume the state in which the type wheels 24,28 and 27 are rotating.

In the state shown in FIG. 8 in which the first carriage has been moved by one column pitch, the type wheel 28 for function characters has been moved also by a distance corresponding to one column pitch to take the position confronting the first mask 31. The first type wheel 24 in this state still confronts the first mask 31, while the second type wheel 27 is held in the position confronting the second mask 33. The solenoid 8 is energized in this state in accordance with the printing instructions as stated before, so that a series of operation, i.e. selection of the type, driving of the hammer member and the column shift of the carriage 22 by one column pitch, is performed.

In this state, all of the three type wheels 24,28 and 27 are confronting respective masks 31 and 33, so that no printing is made on the printing paper but the column shift or carry of the first carriage 22 is effected solely.

As the carriage 22 is shifted from the state shown in FIG. 8, the first type wheel 24 leaves the position confronting the first mask 31 to the position confronting the striking surface 16*a* of the hammer member 16. (See FIG. 9)

At the same time, the type wheel 28 for function characters biased by the spring 30 is shifted following the shift of the first carriage 22. At this moment, the cylindrical portion 28*a* (See FIG. 1) of the type wheel 28 comes into contact with the step 1*c*; of the type wheel shaft 1 to prevent further movement in the column direction, i.e. in the leftward direction, so that the type wheel 28 is made to stop at a position confronting the mask 31.

Figure 9:
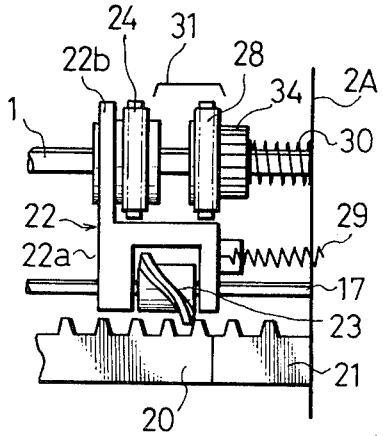

In this carry operation, as will be seen from FIG. 9, the first screw member 23 held by the first carriage 22 is disengaged from the first rack 21 and brought into engagement with the second rack 20. Thereafter, only the first type wheel 24 is shifted by the engagement between the carriage 22 and the rack 20, so that numeral characters are printed one by one from the rightmost column on the printing paper 32. Then, as the printing of one line is finished, the rack shaft 19 is rotated by a suitable means such as electromagnetic means to disengage the rack 20 from the screw member 23 thereby to permit the first carriage 22 to be reset to the home position by the tension exerted by the spring 29. In consequence, the type wheels 24,28 resume the initial condition as shown in FIG. 1 to prepare for the printing of the next line.

The first mode of operation in which the printing is made at first by the function character type wheel 28 and then by the first type wheel 24 has been described.

The second mode of operation, i.e the printing by the second type wheel 27 following the printing by the function character type wheel 28, is performed in a manner explained hereinunder.

In this second mode of operation also, printing is made at first by the function character type wheel 28 from the stand-by state shown in FIG. 1. To this end, a series of operations including the selection of type, driving of hammer member 16 and the column shift of the first carriage 22 by one pitch is performed. In the type selecting operation in this case, the type wheel shaft 1 makes one full rotation for applying the type elements on the peripheries of the type wheels 24,28 and 27 with ink followed by a less than one full rotation for bringing the selected type element on the type wheel to the position confronting the striking surface 16*a* of the hammer member 16 and additional suitable number of rotations, e.g. two additional rotations.

Namely, the minimum rotation number in the second mode of operation in which the printing is made by the second type wheel 27 following the printing by the function character type wheel 28 is selected to be greater than the maximum rotation number in the first mode of operation in which the printing is effected by the first type wheel 24 following the printing by the function character type wheel 28.

Figure 6:
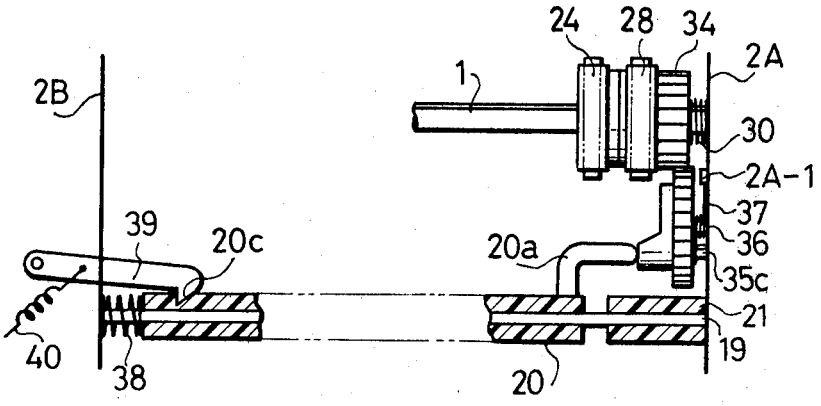
Figure 7:
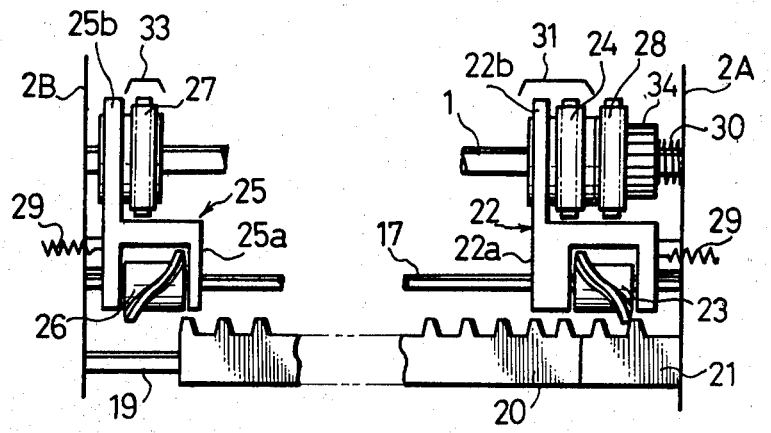
FIGS. 7 to 12 are illustrations for explaining the manner of shifting the carriage.
Figure 10:
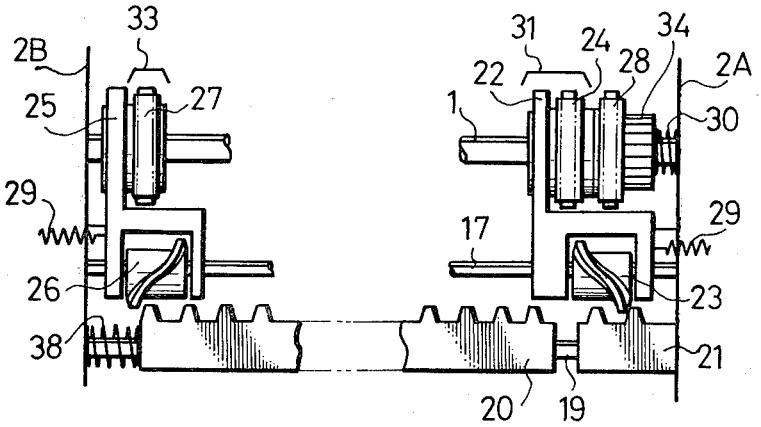

Thus, in the second mode of operation, the upper limit of the angle of rotation of the cam gear 35 engaging the gear 34 is selected to be greater than that in the first mode of operation, so that the end of the lever 20*a* projecting from the rack member 20 is allowed to contact the protrusion 35*d* of the cam gear 35. Therefore, the rack 20 is moved toward the frame member 2B as shown in FIG. 6 to cause the aforementioned retainer claw 39 to engage the notch 20*c* formed in the rack member 20. In consequence, as shown in FIG. 10, the second screw member 26 carried by the second carriage 25 may be engaged with the rack 20.

At the moment of the carry operation after the printing by the function character type wheel 28, the gear 34 leaves its engagement with the cam gear 35, so that the latter is returned to the position shown in FIG. 6 back to the initial position shown in FIG. 4 by the force of the reset spring 36. In consequence, the protrusion 35*d* of the cam gear 35 is moved out of engagement with the lever 20*a* projecting from the rack 20. However, as a result of the engagement between the retainer claw 39 and the notch 20*c*, the rack member 20 is held at the position shown in FIG. 6.

Therefore, at the time of the first carry, the second carriage 25 is moved toward the frame member 2A simultaneously with the shift of the first carriage 22, so that the second type wheel 27 is moved away from the position in front of the mask 33 to the position confronting the striking surface 16*a* of the hammer member 16.

In the series of operations including the type selection, driving of the hammer member 16 and the column shaft, the printing by the second type wheel 27 solely is effected at the leftmost column, because in this state the function character type wheel 28 and the first type wheel 24 face the first mask 31.

Figure 11:
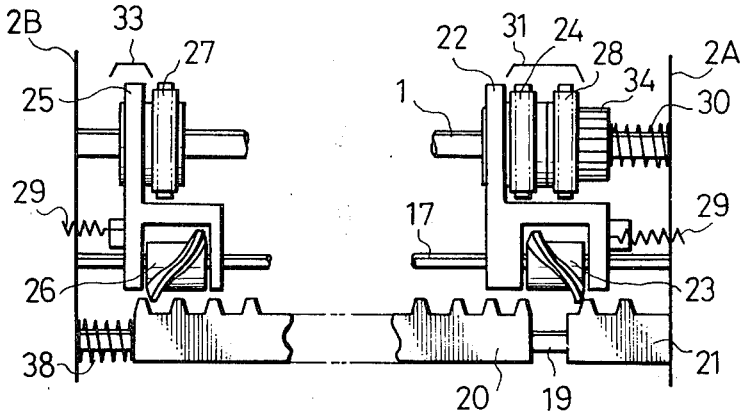
Figure 12:
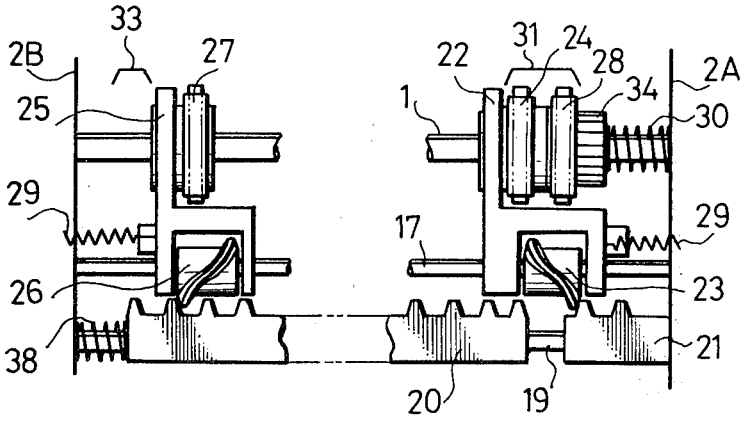

In the subsequent column shift or carry operation, the second carriage 25 is moved from the leftmost column rightwardly by one pitch due to the engagement between the rack 20 and the second screw member 26. On the other hand, since in this state the first screw member 23 is spaced from the rack 20 as shown in FIG. 11, there is no mutual engagement between these two members 23,20, so that the first screw member 23, i.e. the first carriage 22, is never shifted leftward from the position shown in FIG. 11, but is held at the position where the screw member 23 engages the rack 21, i.e. at the position where the function character type wheel 28 and the first wheel 24 oppose the first mask 31.

Thereafter, the series of operations including the selection of type, driving of the hammer member 16 and the column shift is achieved to effect the printing of the desired character by the second type wheel 27 successively from the left column to the right columns one by one. In this case, since the type elements on the second type wheel 27 is applied with an ink of a color different from that of the first type wheel 24, the characters printed by the second type wheel can be clearly distinguished from those made by the first type wheel by color.

After the completion of printing over one line, the rack shaft 19 is rotated by suitable means such as an electromagnetic means as in the case of the foregoing operation, so that the rackes 20,21 are disengaged from the screw members 23,26 to permit the first and second carriages 22 and 25 to be reset to their home positions by the tension exerted by the spring 29. Simultaneously, as a result of rotation of the rack 20, the retainer claw 39 is disengaged from the notch 20*c* in the rack 20, so that the rack 20 is returned by the force of the spring 38 toward the frame member 2A to resume the initial position shown in FIG. 7.

Thus, the type wheels 24,28 and 27, and the rack 20 are reset to the stand-by position as shown in FIG. 1. Thereafter, the printing by the first type wheel 24 and the printing by the second type wheel 27 are achieved selectively by suitably selecting the number of the type wheel in the home position.

In the described embodiment, the second type wheel 27 is adapted to effect the printing from the leftmost column toward the right. In the case where there is no need for printing in the leftmost column, a blank portion, i.e. a portion where no type element is formed, is positioned to confront the striking surface of the hammer member 16 when the second type wheel 27 is positioned at such a column.

Although in the described embodiment the type element of the first and second type wheels are applied with inks of different color to achieve two-color printing, this is not exclusive and the printing may be made in a single color. In the latter case, the second type wheel preferably carries type elements of various characters having a lower frequency of use such as sin, cos, some alphabet characters, fractional symbols or the like, of ordinary numeral characters. By so doing, it is possible to remarkably diversify the content of the printable data by an increase of the number of kinds of characters held by the printer as a whole.

Figure 13:
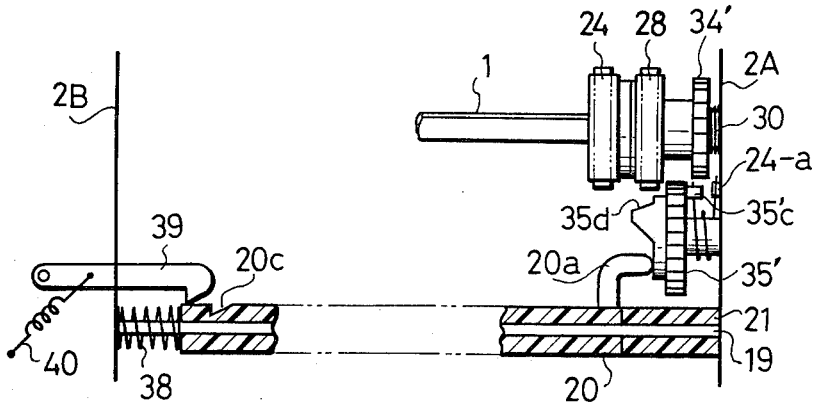
FIGS. 13 and 14 are illustrations of the operation of a cam gear and a rack in another embodiment.
Figure 14:
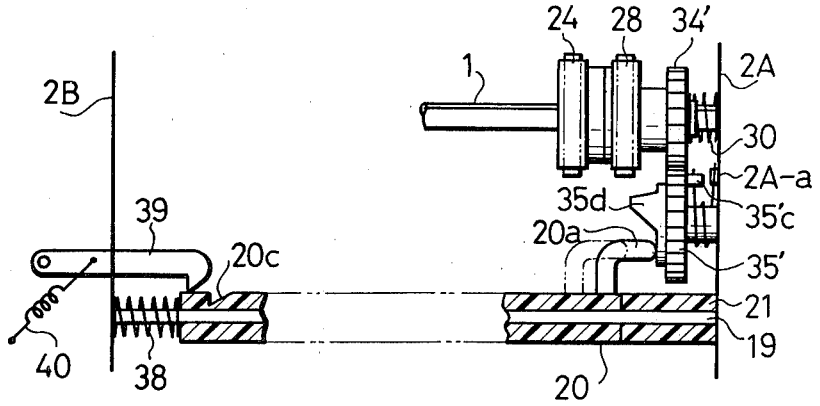

In the described embodiment, the change of the position of the rack 20 is achieved by a selection and control of the number of rotations of the type wheel shaft 1 when the first carriage 22 takes the home position. This arrangement may be substituted by the following arrangement. Namely, as shown in FIGS. 13 and 14, a gear 34' is allowed to engage with a cam gear 35' only when the first carriage 22 has been shifted by one pitch of column, i.e. only after the function character type wheel 28 and the gear 34' have been moved by one column pitch as a result of the shift of the first carriage 22. The number of rotations of the gear 34', i.e. the number of rotations of the type wheel shaft 1, is selected and controlled in this state to effect the selection of the rack 20 thereby to determine which one of the first and the second carriages 22 and 25 should be shifted thereafter.

As has been described, according to the invention, there is provided an impact serial printer which inherently has a small size and simple construction, wherein the printing of each line is effected by a selective shifting of two shiftable type wheels, so that it is possible to effect two-color printing and to increase the number of characters, i.e. the content of the printable data can be increased advantageously. In addition, it is not necessary to use a specific power source for the selection of the carriage to be shifted, because this selection can be made by the selection of the position of the rack making use of the same power source used for rotatively driving the type wheels.

What is claimed is:

1. A serial printer having a plurality of carriages carrying respective type wheels and each adapted to be shifted to desired positions along a line to be printed, comprising:

(a) a first carriage adapted to be moved from a first reset position to various printing positions along a line to be printed, said first carriage rotatably carrying a first type wheel and rotatably carrying a first screw member having a spiralling tooth formed over at least a portion of its circumference;

(b) a second carriage adatped to be moved from a second reset position to various printing positions along a line to be printed, said second carriage rotatably carrying a second type wheel and rotatably carrying a second screw member having a spiralling tooth formed over at least one portion of its circumference;

(c) means including a type wheel drive shaft for rotating said first and second type wheels;

(d) means for rotatively driving said type wheel drive shaft;

(e) means including a screw member drive shaft for rotating said first and second screw members;

(f) means for rotatively driving said screw member drive shaft;

(g) a hammer member having a striking surface having a length corresponding to the printing area of one line of printing;

(h) means for driving said hammer member;

(i) said hammer member being unable to strike said first type wheel when said first carriage takes said first reset position;

(j) said hammer member being unable to strike said second type wheel when said second carriage takes said second reset position, said second reset position for said second carriage being located oppositely along the line to be printed from said first reset position for said first carriage; and (k) an elongated rack adapted to be moved between two positions each causing said rack to engage a respective one of said first and second screw members, and means for sliding said rack longitudinally between said two positions so that said screw members may selectively be made to engage with the teeth of said rack thereby to shift the associated carriage.

2. A serial printer as claimed in claim 1, wherein the respective spiralling tooth of said first and second screw members being inclined in opposite directions, so that said first and second carriages are shifted in opposite directions by the rotation of said screw member driving shaft in one direction.

3. A serial printer as claimed in claim 2, characterized by further comprising a spring means for biasing said first and second carriages to their respective first and second reset positions, and means for rotating said rack into a position where it cannot engage either of said first or second screw members for returning the respective carriages to their respective reset positions.

4. A serial printer as claimed in claim 1, characterized by further comprising:

(a) means including a rotary cam adapted to be rotated by said type wheel drive shaft; and (b) means for selectively sliding said rack in accordance with the rotational position of said rotary cam.

5. A serial printer as claimed in claim 1, said first and second type wheels each carry a plurality of respective type elements and respective means for applying ink to said type elements, the ink applied to the type elements of said first type wheel being of a color different than the ink applied to the type elements of said second type wheel.

6. A serial printer having a first carriage carrying a type wheel and adapted to be moved along a line to be printed; a second carriage carrying a type wheel and adapted to be moved along the line to be printed; means connected to said first and second carriages for urging them to respective home positions adjacent opposite end portions of the maximum extent of a line to be printed; and means for moving either of said first and second carriages selectively along the line to be printed; said means including a respective screw member held rottably to each of said first and second carriages and each having a respective spiral portion extending outwardly from at least a portion of the periphery of said screw member, means for rotating said screw members simultaneously, means including a rack having teeth, said rack extending along said line to be printed, said rack being movable longitudinally to move its teeth selectively into engagement with the spiral portion of either one of said screw members for enabling the screw member held in engagement therewith to be moved along the line to be printed during rotation thereof to move the respective carriage, and means connected to said rack for moving it selectively into engagement with either one of said screw members for moving the associated carriage along said line to be printed.

7. A serial printer according to claim 6, further including means connected to said rack for moving it out from its engagement with either of said screw members for enabling the associated carriage to be returned to its home position by said urging means.

8. A serial printer according to claim 6, further including print means including a hammer extending across the line to be printed for pressing a record paper directly against the periphery of said type wheels, said hammber being incapable of directly contacting the record paper when the respective carriage is in its home position.

9. A serial printer according to claim 6, the spiral portions of each of said screw members being formed in opposite orientations to move their respective carriages in opposite directions along the line to be printed.

10. A serial printer according to claim 6, said means for moving said rack including means urging said rack into normal engagement with one of said screw members, a rotary cam engaging an end portion of said rack and having a protrusion adapted to slide said rack out of engagement with the normally engaged screw member and into engagement with the other screw member, means to rotate said rotary cam to position said protrusion to slide said rack into engagement with said othr screw member, and means for holding said rack into engagement with said other screw member until printing along the line by the associated carriage is completed.

11. A serial printer according to claim 10, means including a common rotary shaft extending through each said type wheel of said first and second carriages for rotating said type wheels to print a selected one of the type elements carried on their periphery into a printing position, and means connected to said rotary shaft with said first and second carriages in their home position for rotating said rotary cam and engaging said rack with said protrusion only after a predetermined revolution of said rotary shaft, whereby said rack can be positioned by rotation of said rotary shaft.

12. A serial printer according to claim 10, further including means connected to said rack for moving it out from its engagement with either of said screw members for enabling the associated carriage to be returned to its home position by said urging means, said holding means releasing its engagement with said rack as said rack is moved out of engagement with either of said screw members.

13. A serial printer according to claim 6, said first and second type wheels each carry a plurality of respective type elements and respective means for applying ink to said type elements, the ink applied to the type elements of said first type wheel being of a color different than the ink applied to the type elements of said second type wheel.

* * * * *